US005915939A

United States Patent [19]

French

[11] Patent Number: 5,915,939

[45] Date of Patent: Jun. 29, 1999

[54] SLING WITH MOLDED PLASTIC SWIVEL CONNECTORS

[75] Inventor: John M. French, Boise, Id.

[73] Assignee: Michaels of Oregon Co., Oregon City, Oreg.

[21] Appl. No.: 09/008,213

[22] Filed: Jan. 16, 1998

[51] Int. Cl.[6] ..... F41C 33/04

[52] U.S. Cl. ..... 42/85; 224/150; 403/265; 24/265

[58] Field of Search ..... 42/85; 24/25, 265 EC; 224/150; 248/683; 403/265, 267

[56] References Cited

U.S. PATENT DOCUMENTS

| | | | |
|---|---|---|---|
| 980,269 | 1/1911 | Hunold | 24/265 EC |
| 5,074,069 | 12/1991 | Shire | 42/85 |
| 5,148,582 | 9/1992 | Dennis, Jr. | 24/265 |
| 5,325,618 | 7/1994 | Turner | 42/85 |
| 5,440,787 | 8/1995 | Figueroa et al. | 24/265 A |
| 5,802,756 | 9/1998 | Hightower | 42/85 |

*Primary Examiner*—Charles T. Jordan
*Assistant Examiner*—Denise J. Buckley
*Attorney, Agent, or Firm*—Chernoff, Vilhauer, McClung & Stenzel, LLP

[57] ABSTRACT

A sling system for attachment to a firearm using conventional sling-mounting studs, or for attachment to luggage, and including a molded plastic connector portion attached permanently to a strap portion by being molded in place onto an end of the strap portion. The strap portion may be of tubular cloth enclosing a padding element that is adhesively attached to the interior of the tubular cloth portion. The connector portion of the sling includes a pair of legs each defining one of a pair of collinear bores to receive a swivel pin extending between the legs to attach the connector to an article to be carried.

27 Claims, 3 Drawing Sheets

SLING WITH MOLDED PLASTIC SWIVEL CONNECTORS

BACKGROUND OF THE INVENTION

The present invention relates to slings for carrying things, and in particular to a firearm sling incorporating a sling swivel.

Elongate carrying straps have long been used to carry rifles and shotguns and various articles of luggage. Such carrying straps or slings have previously been made of leather or heavy cloth webbing attached by the use of various hooks or buckles providing for adjustment of length in use. In attaching such slings to firearms, end portions of the straps have been extended and doubled back through loops, usually of metal, that are mounted on a firearm so that the loop is free to swivel about an axis usually extending transversely with respect to the length of the firearm and parallel with the width of the sling strap. Usually such loops, known as sling swivels, are mounted on a head of a sling mounting stud attached to a stock portion of a firearm, and are free to swivel with respect to it. Sling swivels are shown, for example, in U.S. Pat. Nos. 4,505,012 and 5,067,267.

Slings and sling swivels in the past have been somewhat costly, and yet some of such slings have not been particularly comfortable in use.

Sling swivels made of metal have in some cases been undesirably noisy, and some metal sling swivels are relatively costly. Sling swivels made of other materials such as high strength plastics have been quieter and less costly to make, but have been thought by some not to be strong enough, or have had a bulky appearance thought by some not to be pleasing. Sling straps made of natural textile fibers or leather may be susceptible to mildew and rot in damp climates, or may hold moisture where it can cause corrosion or damage to the finish of a firearm.

What is needed, then, is an improved sling system for firearms that is low in cost, yet rugged and strong enough to be functional, while being pleasing in appearance and comfortable in use. Preferably such a sling system should be manufactured of materials which are resistant to abrasion, mildew and rot, as well as being quick to dry, in order to avoid retention of moisture which might cause harm to expensive firearms on which such slings are used.

SUMMARY OF THE INVENTION

The present invention provides an improved carrying sling for use in carrying objects such as rifles and shotguns, in which a connector including a swivel portion is permanently attached to a strap portion, so that the connector can be attached to a conventional sling mounting stud by a swivel pin or screw mounted in the swivel portion of the connector. The connector is simultaneously formed and attached permanently to an end of a strap portion of such a sling by molding a body of a strong plastic material around an end portion of the strap. The connector in a preferred embodiment of the invention includes a pair of legs separated by an opening or space large enough to receive a sling swivel mounting stud, and each leg defines one of a pair of collinear bores which receive a swivel pin extending through the space between the legs to attach the sling to the sling swivel stud. In one embodiment of the invention the sling strap member may include a length of a tube woven of synthetic fibers and enclosing a padding element to provide for comfort without sacrifice of strength.

In one embodiment of the invention a swivel pin is retained by the use of a compression spring, keeping the swivel pin in position to connect the sling to a sling swivel stud under all normal circumstances, yet allowing the swivel to be disconnected from a swivel stud easily when necessary.

In one embodiment of the invention the woven fabric tube of the strap portion may include portions of contrasting color or of reflective material, to improve appearance and to enhance visibility of the sling.

A feature of one embodiment of the invention is the inclusion of slip-resistant threads woven into the material of the sling strap.

In another embodiment of the invention a swivel pin is held in place by friction between its end portions and the collinear bores in the legs of the swivel body.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figures 1, 2, 3, 4, 5:
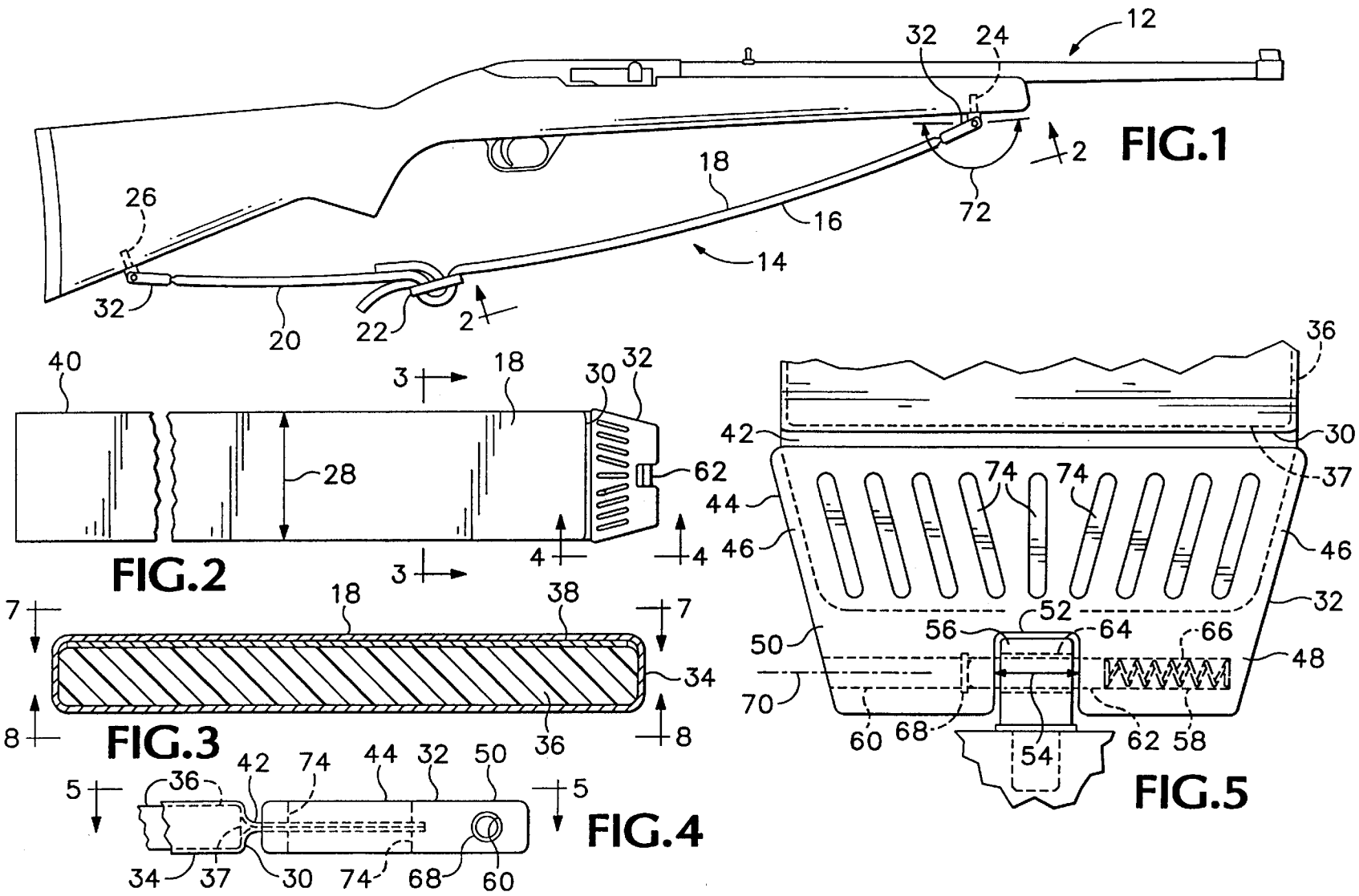
FIG. 1 is a side elevational view of a rifle equipped with a sling which is an embodiment of the present invention.
FIG. 2 is a view of a forward portion of the body of the sling shown in FIG. 1, taken in the direction indicated by the line 2—2.
FIG. 3 is a section view of the portion of the sling shown in FIG. 2, taken along the line 3—3, at an enlarged scale.
FIG. 4 is a view of a portion of the sling shown in FIG. 2, taken along the line 4—4, at an enlarged scale.
FIG. 5 is a view taken along line 5—5 of FIG. 4 of the portion of a sling shown in FIG. 4, together with a sling swivel base.

Referring now to the drawings, in FIG. 1 a rifle 12 is shown equipped with a sling 14 embodying the present invention. The sling 14 has an elongate sling body 16 including a flexible, elongate, forward sling body member 18 and a flexible elongate, rearward sling body member 20 interconnected with each other adjustably by a buckle 22, so that the overall length of the sling 14, between a pair of sling mounting studs 24 and 26, is adjustable.

As shown in FIG. 2, the elongate forward sling body member 18 has the general characteristics of a padded strap having a comfortable width 28. At an outer end 30 of the elongate sling body member 18 is a connector 32 of a molded plastics material attached to the outer end 30 by being molded in place, as by injection molding of suitable thermoplastic material directly onto and around a part of the material of which the forward sling body member 18 is made.

The forward sling body member 18 may be made, for example, of a tubular outer portion or sleeve 34 of cloth material as shown in FIG. 3, with a generally rectangular padding element 36 made of material such as a suitable synthetic plastic foam material located within the tubular cloth outer portion or sleeve 34, and preferably held securely in the desired position within the tubular cloth sleeve as by use of a layer 38 of an adhesive material. At an inner end 40 of the body member 18, the padding element 36 is not present and the tubular cloth sleeve 34 may be collapsed to a smaller thickness to be fastened by the buckle 22 as shown in FIG. 1.

The padding element 36 has an end 37 a small distance away from the extreme end of the tubular cloth sleeve 34, as may be seen best in FIGS. 4 and 5. The tubular cloth sleeve 34 is flattened, as shown at 42, and extends within the body portion 44 of the connector 32, which is molded around an end portion of the tubular cloth sleeve 34. As shown in FIG. 5, the margin portions 46 of the tubular cloth sleeve 34 may be trimmed to fit within a tapered shape of the body 44 as seen in plan view, that is, as seen from the inside or outside of the sling 14 in its usual position attached to the rifle 12.

The body 44 of the connector 32 extends further away from the strap-like body member 18 of the sling 14 and defines a pair of legs 48 and 50. A U-shaped opening or space 52 defined between the legs 48 and 50 has a width 54 great enough to receive a swivel base, such as the head 56 of a swivel mounting stud 26. A first bore 58 is defined within the leg 48 and a second bore 60 is defined within the leg 50. The two bores 58 and 60 are collinear with each other and large enough to receive a swivel pin 62 that extends through a corresponding bore 64 defined within the head 56 of the swivel-receiving stud 24 or 26. The opposite ends of the swivel pin 62 are located, respectively, in the bores 58 and 60.

Figure 6:
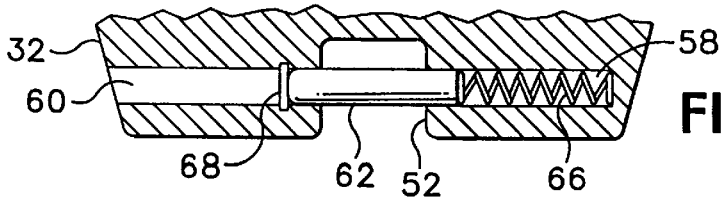
FIG. 6 is a view similar to that of a portion of FIG. 5, but cut away and showing a swivel portion of a connector portion of the sling shown in FIGS. 2–5.

A spring 66, for example, a small helical compression spring, is located within the bore 58 and pushes against the end of the swivel pin 62, urging the swivel pin 62 out of the bore 58 and toward the bore 60, as may best be seen in FIG. 6. A retainer 68, such as a small resiliently expanding ring, is located within the bore 60, engaged with the interior wall thereof, and retains the swivel pin 62 within the bores 58 and 60 extending across the space 52 between the legs 48 and 50 through the bore 64. The swivel pin 62 thus keeps the connector 32 attached to the head 56 of the swivel stud 24 or 26, or to another swivel base, and allows the connector 32 to pivot about swivel axis 70 defined by the swivel pin 62, through an angle 72 as shown in FIG. 1, for example, depending on how much slack is available in the sling 14.

The elongate body 16 of the sling is more or less flexible, depending upon the material of which the forward and rearward sling body members 18 and 20 are formed. Such materials may include the tubular cloth sleeve 34 and the padding element 36, or, instead, may be a simple heavy woven webbing, or other specially-made flexible materials of suitable strength, or even a suitable leather strap.

The body 44 of the connector 32 is permanently fastened to the outer end 30 of the sling body member 18 or 20 by being formed in place on and surrounding the outer end portion 30, preferably by forcing suitable molten thermoplastic material into an injection mold under suitably high pressure to force the plastic material into intimate contact with the outer end portion 30 of the sling body member 18 or 20. As the molded thermoplastic material cools it adheres to and becomes intimately attached to the outer end portion 30, and depending on the materials used, may be thermally welded to the surfaces of the outer end portion 30.

To ensure that the molding process accomplishes such attachment, the mold preferably includes clamping ridges or bars which grip the outer end portion 30 of the elongate sling body member tightly, so that the pressure used to inject the thermoplastic material forces the thermoplastic material into contact with the surfaces of the outer end portion 30 but does not force the outer end portion 30 out of the area where the thermoplastic material is being molded in place about the outer end portion 30. Such clamping ridges in contact with the outer end portion 30 leave a number of openings 74 defined through the body portion 44, exposing the surfaces of the outer end 30 between portions 76 of the molded plastic body 44 of the connector 32. While suitable plastics materials of various types may be utilized for the connector 32, it will be understood that a certain degree of strength and rigidity will be necessary, as well as the ability to withstand the temperatures likely to be encountered as a result of heat radiated from a firearm equipped with a sling 14 according to the present invention. Accordingly, it has been found that a material such as a polypropylene plastic resin sold under the trade name MULTIBASE G44D24 available from the Multibase Company, of Grenoble, France, having a Shore D hardness of 44, will serve satisfactorily as the material of the connector 32.

It will be understood that a suitable plastic resin might be injected in a liquid form at a relatively low temperature, with a catalyst added during injection so that the material hardens to the required amount by a process of reaction-setting in place about the outer end portion 30.

Figure 7:
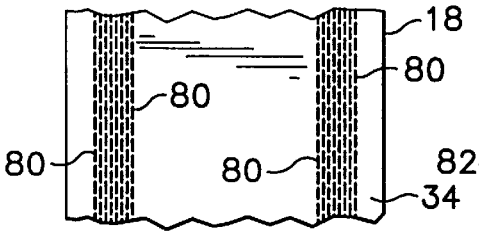
FIG. 7 is a view taken in the direction of line 7—7 of FIG. 3, at an enlarged scale, showing a portion of the body of the sling shown in FIG. 2.
Figure 8:
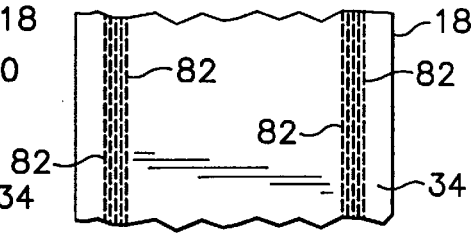
FIG. 8 is a view taken in the direction of line 8—8 of FIG. 3, at an enlarged scale, showing a portion of the body of the sling shown in FIG. 2.

The material for the sling body members 18 and 20 also must be chosen to be durable enough for the intended purpose, and it has been found that a woven tubular material of heavy polypropylene threads forming a cloth of at least about 800 denier, such as that available from Janisset, of Monistrol-Sur-Loire, France as its tubular webbing, is suitable. Consideration must be given to the temperatures at which the plastic and the cloth melt. Preferably, such a tubular material will also include several parallel threads or small strips 80 of rubber-like non-slip material, as shown in FIG. 7, extending longitudinally of the tubular cloth sleeve 34 so as to be located on the inner side of the sling 14. That is, the threads 80 should be on the side of the sling 14 facing toward the stock of a rifle 12 equipped with such a sling, to make the sling 14 less likely to slip off the user's shoulder.

Additionally, it may be desirable to include threads such as parallel threads 82 of a contrasting color or of a reflective material, woven into the opposite side of the tubular cloth sleeve 34, either for decorative purposes, or to provide a measure of safety through high visibility reflectiveness. It will be understood that the sling 14 may be used to carry objects other than military rifles and that in certain cases it may be highly desirable to have such high visibility as may be provided by the inclusion of the reflective threads 82 in such a sling 14. The threads 82 could be of reflective stripe material available from the Minnesota Mining & Mfg. Co. of Minneapolis, Minn., under the trademark SCOTCH LITE.

Figure 9:
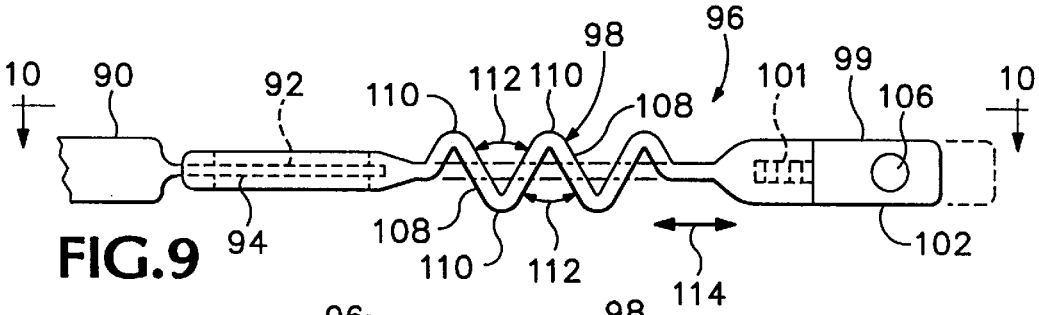
FIG. 9 is a view taken in the same direction as FIG. 4, showing a portion of a sling including a connector which is an alternative embodiment of the present invention.
Figure 10:
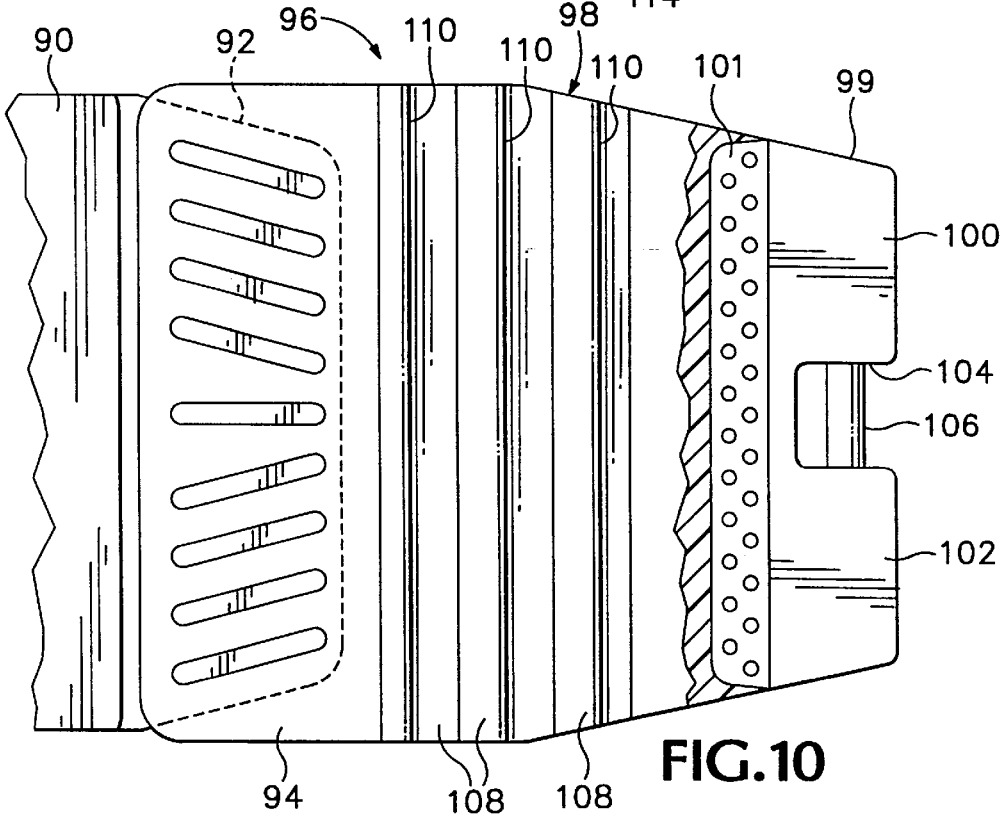
FIG. 10 is a partially cut-away view showing the portion of a sling body and the connector shown in FIG. 9, taken in the direction of the line 10—10.

Referring now also to FIGS. 9 and 10, a sling body member 90 that is an alternative embodiment of the invention may be similar to the sling body members 18 and 20 and includes an outer end portion 92 onto and surrounding which is molded a connector body portion 94 of an elastically extensible connector 96. An elastic central portion 98 of the connector 96 is formed of the same plastic material as the body portion 94 and is over-molded onto and thus securely attached to an outer or swivel portion 99 defining a pair of legs 100 and 102 separated by an opening 104 across which a swivel pin 106 extends. The outer or swivel portion 99 includes a perforated, rearwardly extending fin 101 to provide a strong mechanical connection to the central portion 98, and may be of the same material as the body 44 of the connector 32.

As may be seen most clearly in FIG. 9, the central portion 98 includes several short segments 108 interconnected along transversely extending linear junctions 110 oriented at included angles 112 with respect to each other as a zig-zag portion. In response to tension in such a connector 96, the angles 112 increase as the material of the connector 96 in linear junctions 110 and the segments 108 resiliently flexes and stretches so that the connector 96 can extend and contract in length as indicated by the double-pointed arrow 114. Depending on the elasticity of the plastic -resin material used and the desired amount of potential elongation, the central portion 98 might be flat, without the zig-zag portion, as shown in phantom line in FIG. 9. As in the connector 32, the body portion 94 and central portion 98 may be of a suitable thermoplastic or reaction-setting plastic resin, chosen to provide a desired amount of potential elongation.

Figure 11:
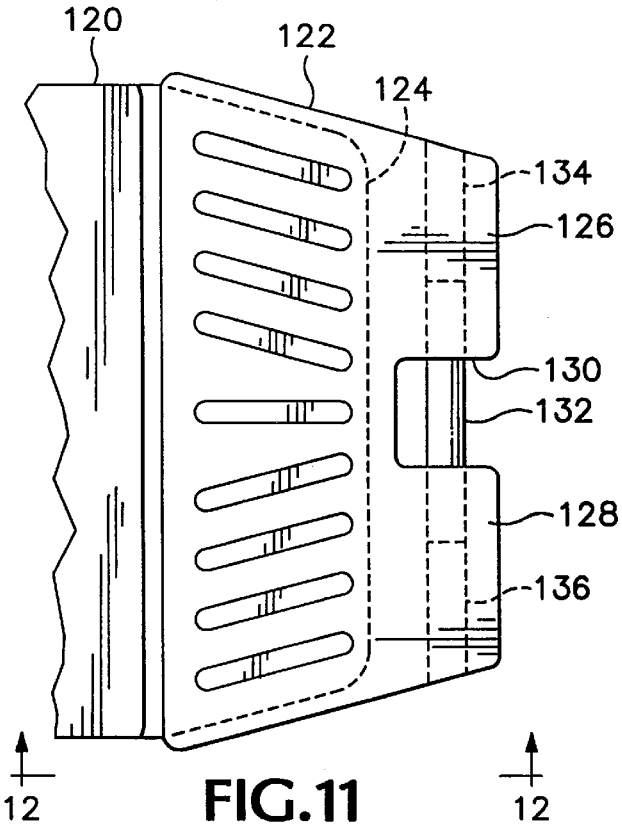
FIG. 11 is a view similar to that of FIG. 5, showing a portion of a sling body and a connector which is yet another alternative embodiment of the present invention.
Figure 12:
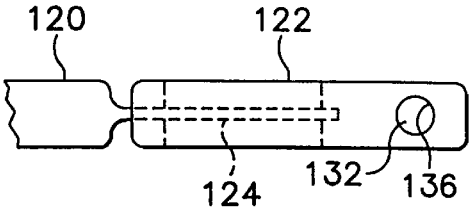
FIG. 12 is a view of the portion of a sling and connector shown in FIG. 11, taken in the direction of the line 12—12.

As may be seen in FIGS. 11 and 12, a further alternative embodiment of the present invention includes an elongate sling body member 120 that may be similar to the sling body member 18, for example, and has a connector 122 attached to an outer end portion 124 thereof similarly by being molded permanently into place on the outer end 124. The connector 122 includes a pair of legs 126 and 128 separated by an opening or space 130, across which a swivel pin 132 extends. Such a swivel pin 132 in such a connector 122 may be held in place in collinear bores 134 and 136 by friction provided by appropriate interference between the interior sizes of the bores 134 and 136 and the size of the swivel pin 132.

Figure 13:
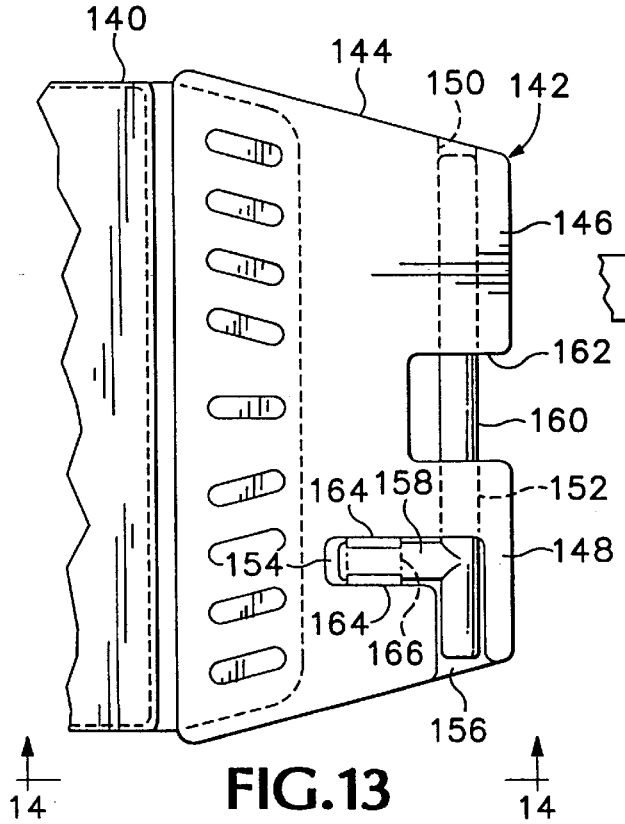
FIG. 13 is a view similar to that of FIG. 5, showing a portion of a sling and a connector which is a further alternative embodiment of the present invention.
Figure 14:
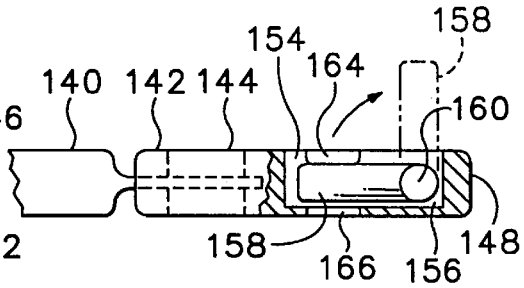
FIG. 14 is a view of the portion of a sling and connector shown in FIG. 13, taken in the direction of the line 14—14.

A portion of a sling body 140 is shown in FIGS. 13 and 14, together with a connector 142 that is a further embodiment of the present invention. The connector 142 has a body 144 that is molded in place onto the end of the sling body 140 in a manner similar to that previously described with respect to the connector 32. The connector 142 has as pair of legs 146 and 148 defining respective collinear bores 150 and 152. The leg 146 also defines a channel or groove 154 aligned with the bore 150. Another channel or groove 156 is oriented at right angles to the groove 154 to receive an arm 158 extending at right angles from a special swivel pin 160 when the swivel pin 160 extends through the bores 150 and 152 and across a space 162 between the legs 146 and 148 to attach the connector 142 to a head of a swivel-receiving stud in the same manner described with respect to the connector 32 and as shown in FIG. 5.

Preferably, a pair of resiliently movable latch members 164, molded as part of the body 144, protrude into the groove 156, in a position interfering with movement of the arm 158, to prevent it from inadvertently swinging outward to a position (as shown in phantom line in FIG. 14) where the arm 158 is free to move along the groove 156 and allow the swivel pin 160 to be retracted from the bores 150 and 152. The latch members 164, because of their resiliency, can be pushed apart far enough by the arm 158 to permit the arm 158 to be pushed into place within the groove 154, where the latch members then keep the arm 158. Preferably, a hole 166 is provided in the opposite side of the body 144 and communicates with the bottom of the groove 154 to enable the arm 158 to be pushed outward from the groove 154 when it is desired to remove the swivel pin 160 from the bores 150 and 152.

While the connectors disclosed above have been disclosed in connection with attachment of a sling to a firearm, it will be understood that similar slings can be used for carrying equipment bags or other articles so long as the article to which the sling is to be attached is equipped with an attachment point including a bore corresponding with the previously-mentioned bore 64 in the head 56 of a sling mounting stud 24.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A sling for carrying an object, comprising:

(a) an elongate flexible sling body member having a pair of opposite ends; and (b) a connector having a body of synthetic plastic material attached to said sling body member by being molded in place onto a portion of one of said opposite ends of said sling body member, said connector also including a pair of legs extending from said body, each said leg defining one of a pair of collinear bores, said legs being spaced apart from each other far enough to receive a sling swivel base between them.

2. The sling of claim 1 wherein said sling body member includes a strap portion of cloth.

3. The sling of claim 2 wherein said strap portion includes a tubular portion enclosing a padding element.

4. The sling of claim 1 wherein said sling includes first and second elongate body members and an adjustable fastener adjustably interconnecting said first and second body members with each other, whereby said sling is adjustable in length.

5. The sling of claim 1, including a swivel pin held within said collinear bores by friction.

6. The sling of claim 1, including a swivel pin extending between said legs and having a pair of opposite ends each located in a respective one of said collinear bores, and also including a spring located in one of said collinear bores, said spring urging said swivel pin toward the other of said collinear bores.

7. The sling of claim 1, including a resilient zig-zag shaped extensible tension spring portion included in said connector.

8. The sling of claim 1, including an elastically extensible portion included in said body of said connector.

9. The sling of claim 1, including a swivel pin extending between said legs and having a respective part thereof located in each of said collinear bores, said pin having an arm extending at an angle and said body of said connector defining a groove arranged to receive said arm of said swivel pins.

10. A sling for carrying a firearm, comprising:

(a) an elongate flexible sling body having a pair of opposite ends;

(b) a connector of synthetic plastic material molded in place onto a portion of one of said opposite ends and thereby attached securely and permanently to said one of said opposite ends, said connector including a body and a pair of legs extending from said body and being spaced apart from each other;

(c) a swivel base located between said legs; and (d) a swivel pin interconnecting said swivel base with said legs and defining a pivot axis for movement of said connector with respect to said swivel base.

11. The sling of claim 10 wherein said sling body member includes a strap portion of cloth.

12. The sling of claim 11 wherein said strap portion includes a tubular portion enclosing a padding element.

13. The sling of claim 10 wherein said sling body includes first and second elongate members and an adjustable fastener adjustably interconnecting said first and second members with each other, whereby said sling body is adjustable in length.

14. The sling of claim 10, each of said legs defining a respective one of a pair of collinear bores, and wherein said swivel pin has a pair of opposite ends held within said collinear bores by friction.

15. The sling of claim 10, each of said legs defining a respective one of a pair of collinear bores, and wherein said swivel pin has a pair of opposite ends each located in one of said collinear bores, and including a spring located in one of said collinear bores, said spring urging said swivel pin toward the other of said collinear bores.

16. The sling of claim 10, including a resilient zig-zag shaped extensible tension spring portion included in said connector.

17. The sling of claim 10, including an elastically extensible portion included in said body of said connector.

18. The sling of claim 10, said swivel pin having an arm extending at an angle and said body of said connector defining a groove arranged to receive said arm of said swivel pins.

19. In combination, a firearm and a sling for carrying said firearm, comprising:

(a) an elongate flexible sling body having a pair of opposite ends;

(b) a connector of synthetic plastic material molded in place onto a portion of one of said opposite ends and thereby attached securely and permanently to said one of said opposite ends, said connector including a body and a pair of legs extending from said body and spaced apart from each other;

(c) a swivel base located between legs;

(d) a swivel pin interconnecting said swivel base with said legs and defining a pivot axis for movement of said connector with respect to said swivel base; and (e) a fastener attaching said swivel base to said firearm.

20. The combination of claim 19 wherein said sling body member includes a strap portion of cloth.

21. The combination of claim 20 wherein said strap portion includes a tubular portion enclosing a padding element.

22. The combination of claim 19 wherein said sling body includes first and second elongate members and an adjustable fastener adjustably interconnecting said first and second members with each other, whereby said sling body is of adjustable length.

23. The combination of claim 19, each of said legs defining a respective one of a pair of collinear bores, and wherein said swivel pin has a pair of opposite ends held within said collinear bores by friction.

24. The combination of claim 19, each of said legs defining a respective one of a pair of collinear bores, and wherein said swivel pin has a pair of opposite ends each located in one of said collinear bores, and including a spring located in one of said collinear bores, said spring urging said swivel pin toward the other of said collinear bores.

25. The combination of claim 19, including a resilient zig-zag shaped extensible tension spring portion included in said connector.

26. The sling of claim 19, including an elastically extensible portion included in said body of said connector.

27. The sling of claim 19, said swivel pin having an arm extending at an angle and said body of said connector defining a groove arranged to receive said arm of said swivel pins.

* * * * *